US006926558B2

(12) United States Patent
Sasai et al.

(10) Patent No.: US 6,926,558 B2
(45) Date of Patent: Aug. 9, 2005

(54) MODULAR JACK

(75) Inventors: Hiroshi Sasai, Tokyo (JP); Mutsumi Kinoshita, Tokyo (JP); Mitsutaka Yasuda, Tokyo (JP); Tadashi Fukuda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/727,606

(22) Filed: Dec. 5, 2003

(65) Prior Publication Data

US 2004/0110422 A1 Jun. 10, 2004

(30) Foreign Application Priority Data

Dec. 6, 2002 (JP) ..... 2002-354461

(51) Int. Cl.[7] ..... H01R 13/66
(52) U.S. Cl. ..... 439/620; 439/676; 439/490
(58) Field of Search ..... 439/620, 676, 439/490

(56) References Cited

U.S. PATENT DOCUMENTS

| | | | | |
|---|---|---|---|---|
| 5,456,619 | A | 10/1995 | Belopolsky et al. | |
| 5,971,805 | A | 10/1999 | Belopolsky et al. | |
| 5,973,932 | A | 10/1999 | Nguyen | |
| 5,986,894 | A | 11/1999 | Lint et al. | |
| 5,999,400 | A | 12/1999 | Belopolsky et al. | |
| 6,116,963 | A | 9/2000 | Shutter | |
| 6,155,844 | A | 12/2000 | Semmeling et al. | |
| 6,159,050 | A | 12/2000 | Belopolsky et al. | |
| 6,171,151 | B1 | 1/2001 | Lu et al. | |
| 6,176,741 | B1 | 1/2001 | Shutter | |
| 6,190,210 | B1 | 2/2001 | Belopolsky et al. | |
| 6,224,417 | B1 | 5/2001 | Belopolsky et al. | |
| 6,224,425 | B1 | 5/2001 | Shutter | |
| 6,225,560 | B1 | 5/2001 | Machado | |
| 6,227,911 | B1 * | 5/2001 | Boutros et al. | 439/620 |
| 6,238,247 | B1 | 5/2001 | Belopolsky et al. | |
| 6,253,451 | B1 | 7/2001 | Semmeling et al. | |
| 6,302,741 | B1 * | 10/2001 | Fasold et al. | 439/620 |
| 6,319,064 | B1 | 11/2001 | Belopolsky et al. | |
| 6,328,603 | B1 * | 12/2001 | Chang | 439/620 |
| 6,428,361 | B1 * | 8/2002 | Imschweiler et al. | 439/676 |

FOREIGN PATENT DOCUMENTS

| | | |
|---|---|---|
| JP | 5-3415 | 1/1993 |
| JP | 9-326272 | 12/1997 |
| JP | 2001-43937 | 2/2001 |
| JP | 2001-68222 | 3/2001 |
| JP | 2001-126820 | 5/2001 |

* cited by examiner

*Primary Examiner*—Truc Nguyen
(74) *Attorney, Agent, or Firm*—Oblon, Spivak, McClelland, Maier & Neustadt, P.C.

(57) ABSTRACT

A first terminal block having first terminals to be in contact with terminals of a plug is incorporated in a housing. The first terminals are exposed to an internal space portion 1*e* of the housing, while the rear ends of the first terminals project at the rear of the block. A second terminal block has second terminals to be connected to a motherboard the modular jack should be attached to. Electronic parts a are mounted on an internal board. The internal board includes through-hole-like terminals or notch-like terminals to which the first and second terminals and should be soldered. Winding terminals of winding parts are inserted and soldered to through holes of the internal board.

8 Claims, 8 Drawing Sheets

MODULAR JACK

BACKGROUND OF THE INVENTION

1. Field of the Invention

The present invention relates to a modular jack including electronic parts therein, and particularly relates to an RJ-45 type modular jack to be used for connecting a LAN cable.

2. Discussion of the Background

For example, a related-art modular jack is disclosed in U.S. Pat. No. 6,319,064. This modular jack is arranged so that a terminal block is incorporated in a housing having an internal space to which a plug should be inserted, and a block that receives electronic parts is incorporated in the terminal block.

The terminal block includes not only first terminals to be brought into contact with terminals of a plug but also second terminals to be connected to a motherboard. The block has a box-like shape that is incorporated on the back surface side of the housing, and that is opened on the housing side (front) for receiving the electronic parts. The upper surface of the block is formed as a connection portion to the first terminals, while the lower surface of the block is formed as a connection portion to the second terminals. The block receiving the electronic parts is mounted on a bottom plate portion of the terminal block extending at the rear thereof, and incorporated in the bottom plate portion. Then, winding terminals of the electronic parts are fitted into a groove provided at the upper opening edge of the block and a groove provided at the lower opening edge of the block respectively. The winding terminals fitted into the grooves are soldered with the rear end portions of the first terminals, and the second terminals, in the upper and lower surface portions of the block receiving the electronic parts, respectively.

In addition, another related-art modular jack having a different structure from that of U.S. Pat. No. 6,319,064 is also known. In this structure, in order to make assembling easier, not only electronic parts but also a modular jack are mounted on one board, and the board with the modular jack is covered with upper and lower covers (see Japanese Patent Publication No. Hei-5-341 51(1993)).

In the modular jack disclosed in U.S. Pat. No. 6,319,064, there is a problem that the soldering work is difficult particularly due to the structure in which the block receiving the electronic parts is mounted on and soldered with the second terminals to be connected to a motherboard. Particularly, when the electronic parts include a winding part such as a transformer or a common mode choke coil as described above, there is a problem that soldering becomes more difficult because the soldering has to be performed while the second terminals and the winding terminals are aligned with each other.

On the other hand, in the structure disclosed in Japanese Patent Publication Hei-5-3415, there is a problem that the total structure including the modular jack becomes large in size.

SUMMARY OF THE INVENTION

In consideration of the foregoing problems belonging to the related art, it is an object of the invention to provide a modular jack which is assembled easily and which can be arranged in a small size.

According to the invention, there is provided a modular jack including: a housing having an internal space into which a plug should be inserted; a first terminal block incorporated in the housing and integrally provided with first terminals to be in contact with terminals of the plug, so that front portions of the first terminals are exposed to the internal space, while rear ends of the first terminals project at the rear of the first terminal block; a second terminal block having second terminals to be connected with a mother board the modular jack should be attached to; and an internal board mounted with electronic parts and including through-hole-like or notch-like terminals to which the first and second terminals should be soldered.

When the electronic parts are mounted thus on the internal board, and the first and second terminals are soldered with the internal board, assembling becomes easy. In addition, the modular jack is not mounted on the board mounted with the electronic parts but arranged so that the terminal block is incorporated in the housing, and the internal board is coupled with the terminal block. Thus, the modular jack can be arranged in a small size.

The modular jack according to the invention is suitably applicable to the case where the electronic parts include at least one of a common mode choke coil and a transformer.

The modular jack according to the invention is suitably applicable to the case where the electronic parts include at least one of a resistor, a capacitor and a light emitting diode.

When the electronic parts include a winding part in the modular jack according to the invention, it is preferable that the internal board has through holes to which terminals of the winding parts are inserted and soldered. When the winding terminals are inserted into the through holes and soldered therewith in advance independently of the terminals of the modular jack, the work of soldering the winding terminals becomes easy.

The modular jack according to the invention can adopt a structure in which the second terminal block is incorporated on the back surface side of the housing, while the internal board is provided between the first terminal block and the second terminal block.

Such a structure is advantageous in view of the number of parts because the second terminal block serves as a cover for covering the included parts.

As another structure of a combination of constituent parts of a modular jack according to the invention, it is possible to adopt a structure in which: the first terminal block and the second terminal block are received and incorporated in the housing so that connection portions of the first and second terminals to the internal board project rearward; the connection portions of the first and second terminals are inserted and soldered to the through-hole-like or notch-like terminals of the internal board; and a cover covering the internal board therewith is provided on the back surface side of the housing.

With such a structure, the work of soldering between the internal board and the first terminals and between the second terminals and the internal board can be carried out at one time. Thus, the assembling work can be performed efficiently.

In the modular jack according to the invention, it is preferable that: a plurality of through-hole-like or notch-like terminals to which the first terminals are inserted and soldered are arrayed in an upper portion of the internal board; and a plurality of through-hole-like or notch-like terminals to which the second terminals are inserted and soldered are arrayed in a lower portion of the internal board.

Figure 1A:
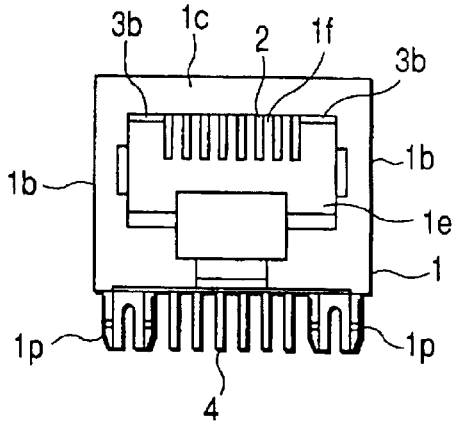
FIGS. 1A–1E show an embodiment of a modular jack according to the invention, FIG. 1A being a front view, FIG.
Figure 1B:
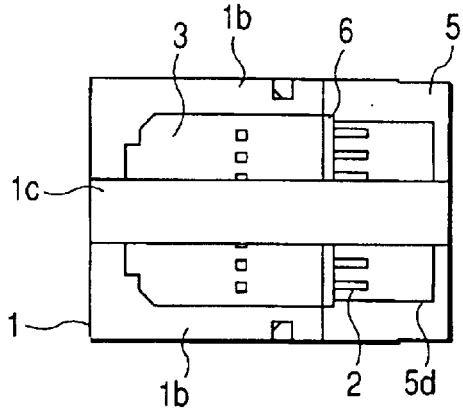
Figure 1C:
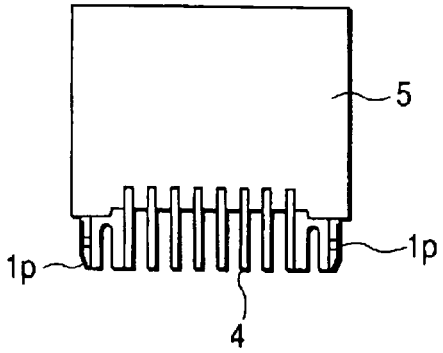
Figure 1D:
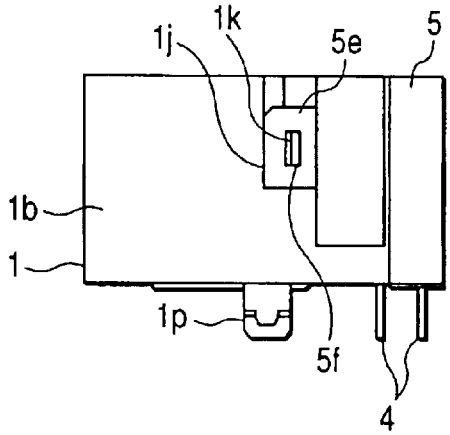
Figure 1E:
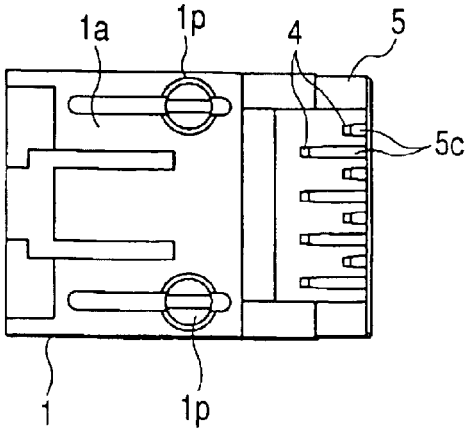

1B being a plan view, FIG. 1C being a back view, FIG. 1D being a side view, FIG. 1E being a bottom view.

Figure 2A:
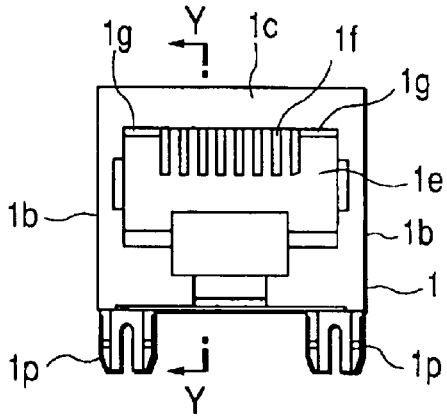
Figure 2B:
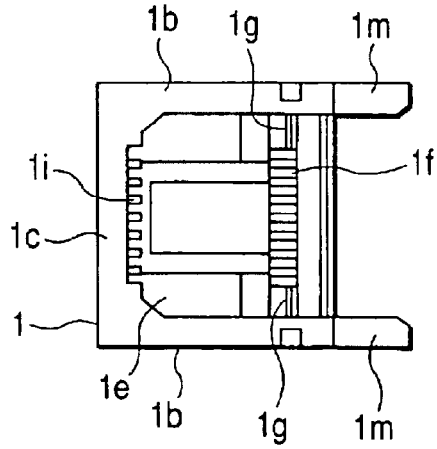
Figure 2C:
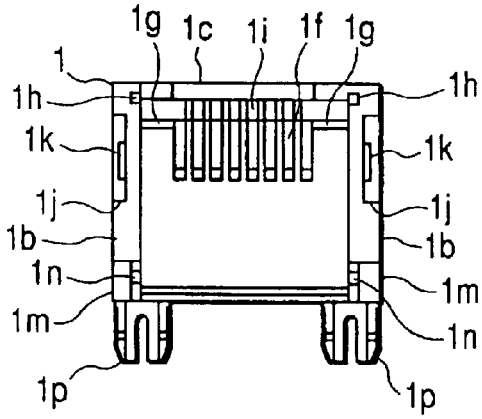
Figure 2D:
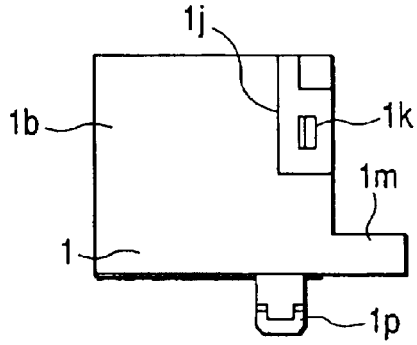
Figure 2E:
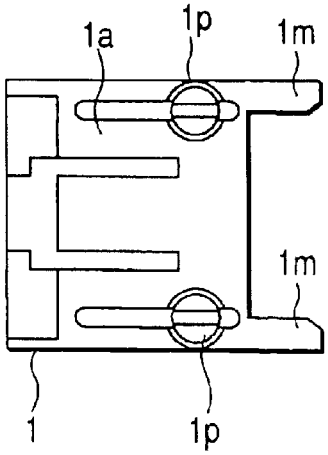
Figure 2F:
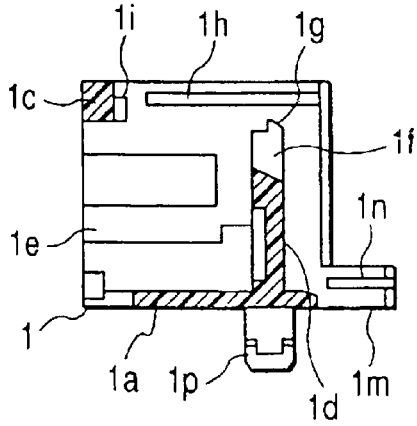

FIGS. 2A–2F show a housing constituting the modular jack shown in FIGS. 1A–1E, FIG. 2A being a front view, FIG. 2B being a plan view, FIG. 2C being a back view, FIG. 2D being a side view, FIG. 2E being a bottom view, FIG. 2F being a sectional view taken on line Y—Y in FIG. 2A.

Figure 3A:
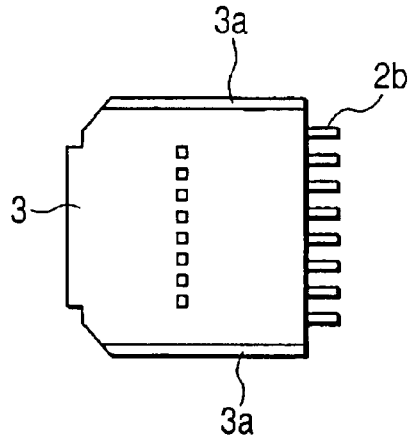
Figure 3B:
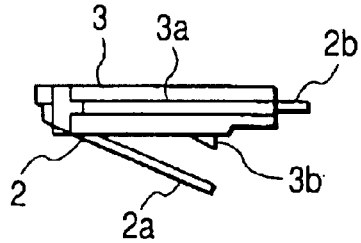
Figure 3C:
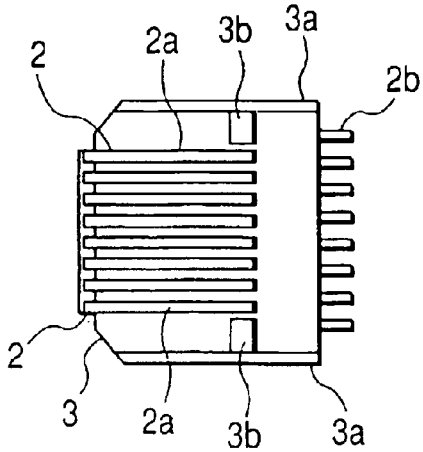

FIGS. 3A–3C show a first terminal block constituting the modular jack shown in FIGS. 1A–1E, FIG. 3A being a plan view, FIG. 3B being a side view, FIG. 3C being a bottom view.

Figure 4A:
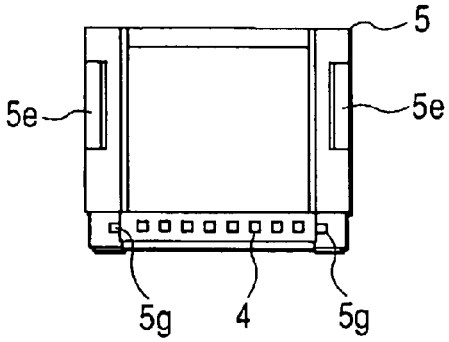
Figure 4B:
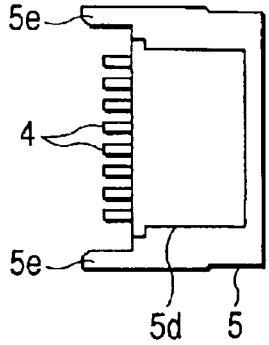
Figure 4C:
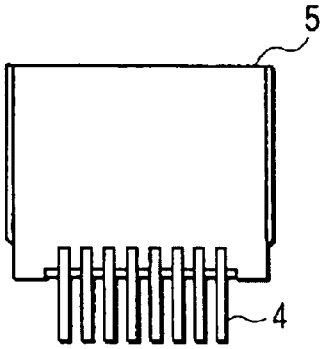
Figure 4D:
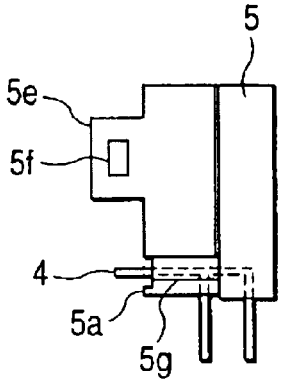
Figure 4E:
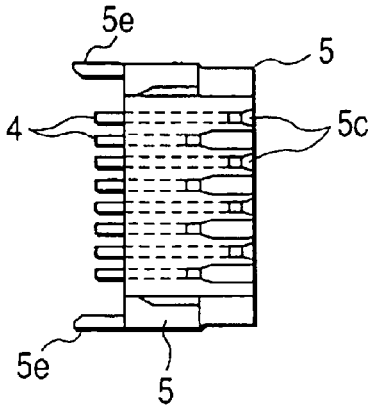
Figure 4F:
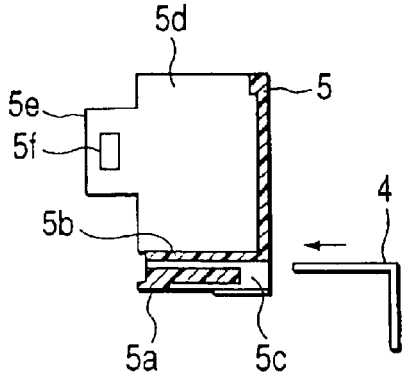

FIGS. 4A–4F show a second terminal block constituting the modular jack shown in FIGS. 1A–1E, FIG. 4A being a front view, FIG. 4B being a plan view, FIG. 4C being a back view, FIG. 4D being a side view, FIG. 4E being a bottom view, FIG. 4F being a sectional view showing the structure in which a second terminal is attached.

Figure 5A:
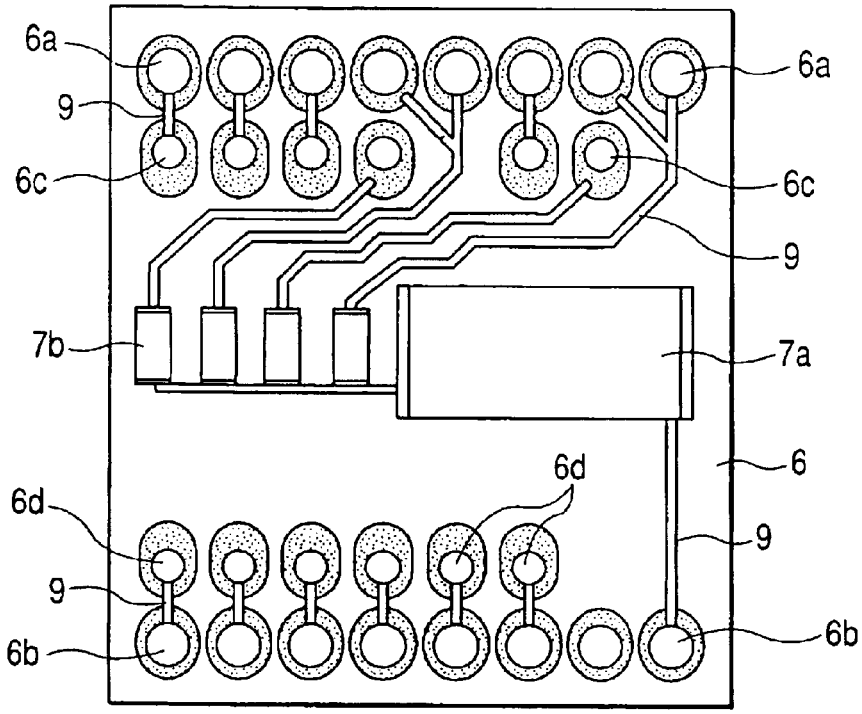
Figure 5B:
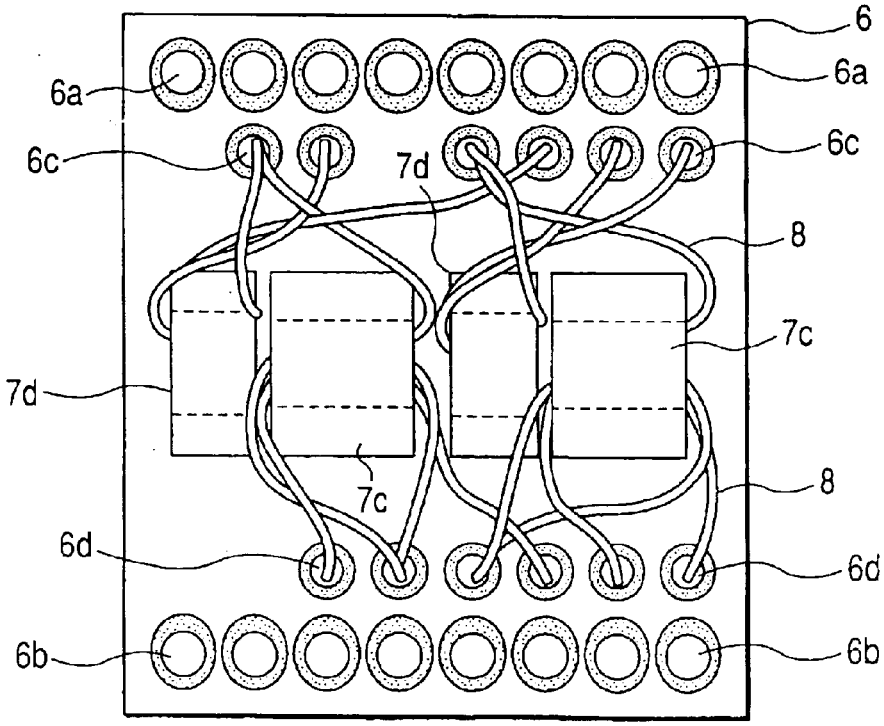

FIGS. 5A–5B show an internal board constituting the modular jack shown in FIGS. 1A–1E, FIG. 5A being a front view, FIG. 5B being a back view.

Figure 6A:
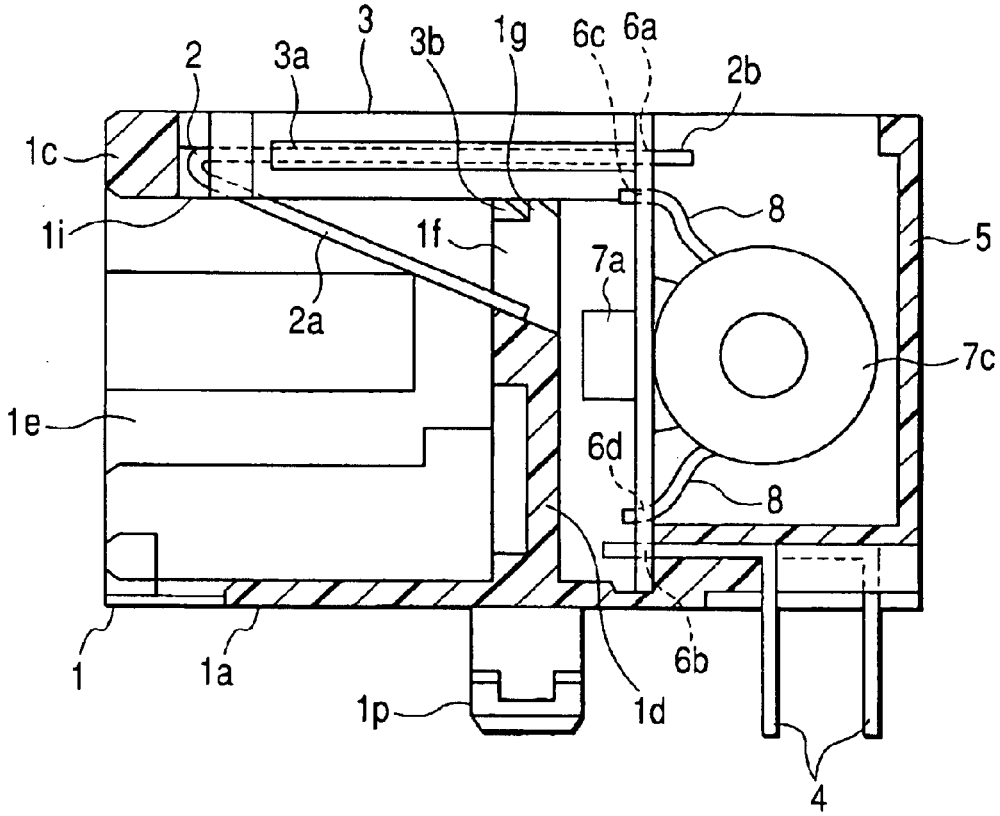
Figure 6B:
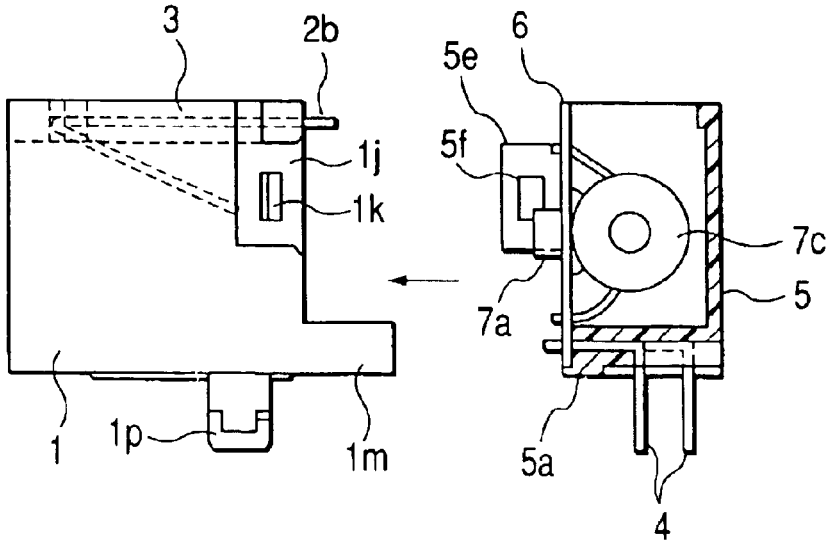

FIGS. 6A–6B show the modular jack shown in FIGS. 1A–1E, FIG. 6A being a sectional view, FIG. 6B being a side view showing the state where the modular jack is being assembled.

Figure 7A:
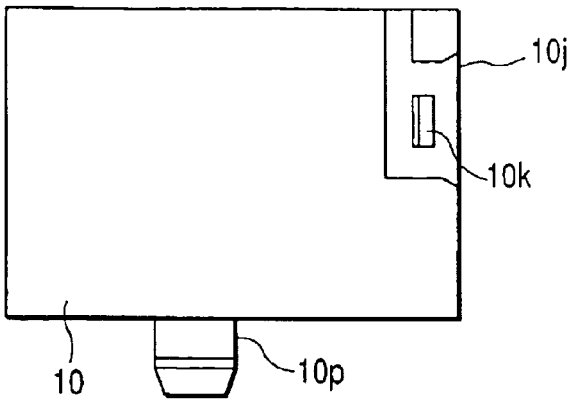
Figure 7B:
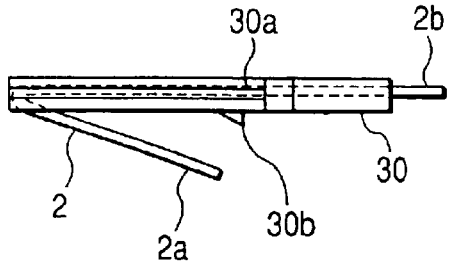
Figure 7C:
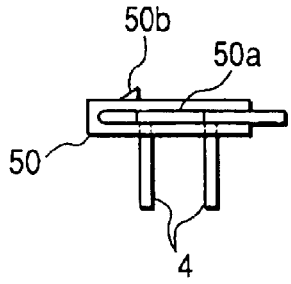
Figure 7D:
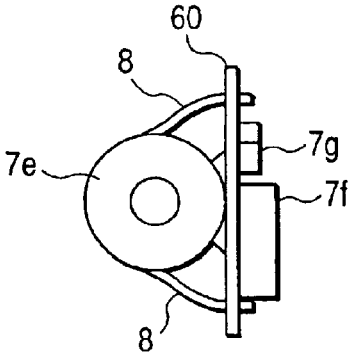
Figure 7E:
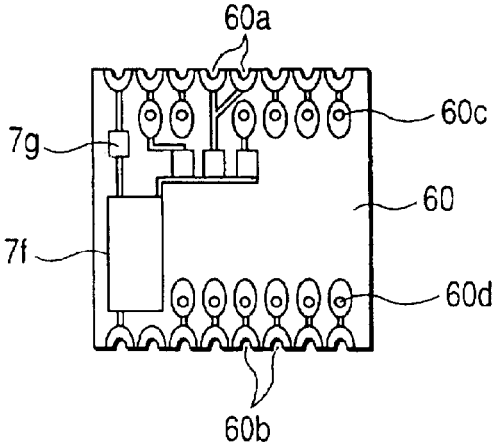
Figure 7F:
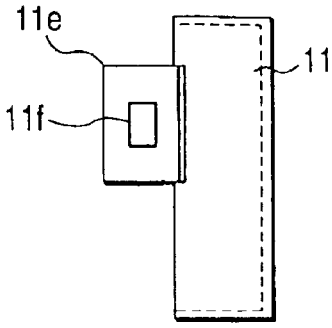

FIGS. 7A–7F show constituent parts in another embodiment of the modular jack according to the invention, FIG. 7A being a side view of a housing, FIG. 7B being a side view of a first terminal block, FIG. 7C being a side view of a second terminal block, FIG. 7D being a side view of an internal board mounted with electronic parts, FIG. 7E being a front view of FIG. 7D, FIG. 7F being a side view of a cover.

Figure 8:
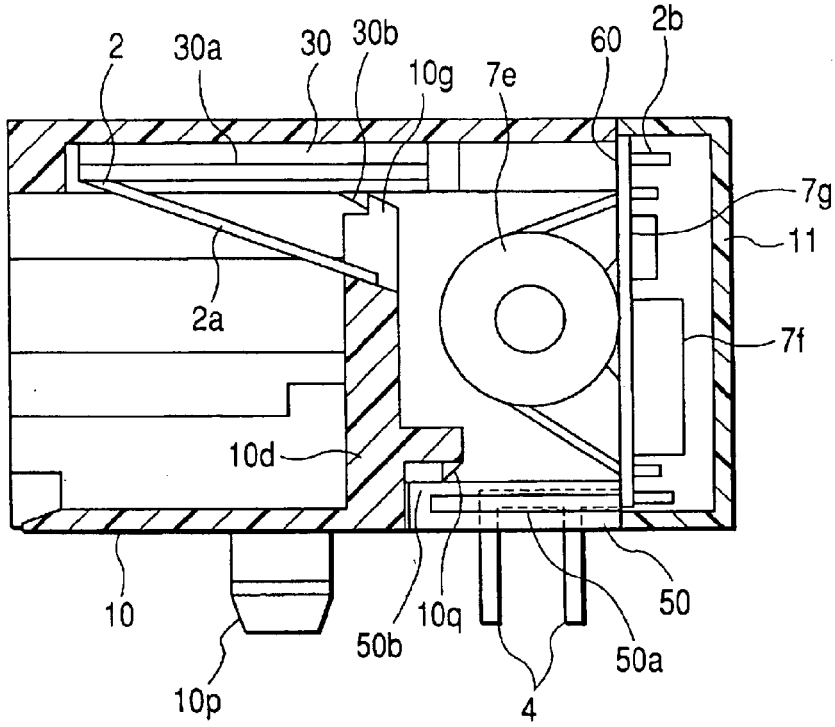

FIG. 8 is a sectional view of the modular jack shown in FIGS. 7A–7E.

Figure 9:
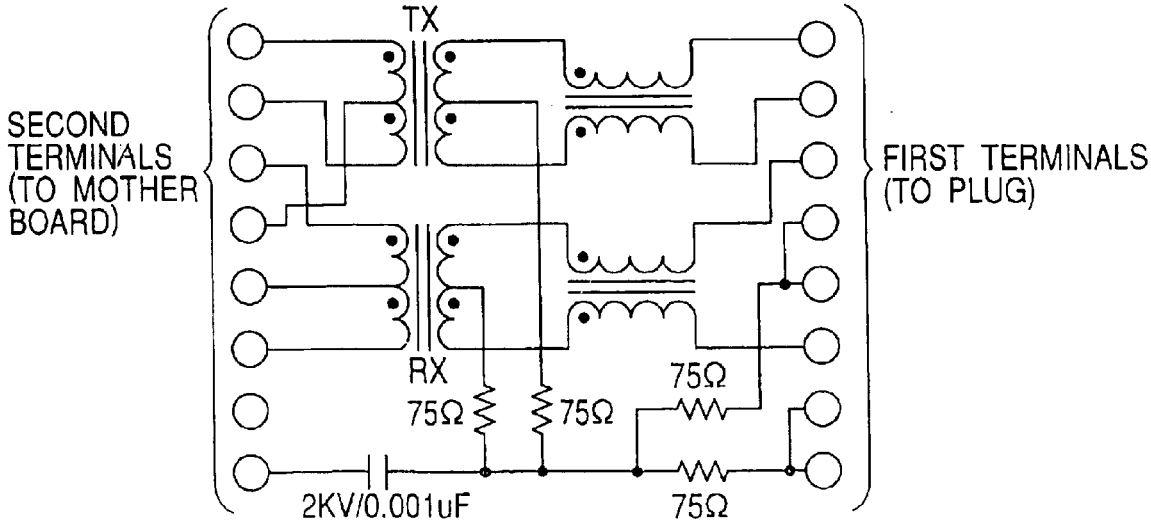

FIG. 9 is a equivalent circuit diagram of an example of the internal circuit board of the present invention.

DETAILED DESCRIPTION OF THE PREFERRED EMBODIMENTS

FIGS. 1A-1E show an embodiment of a modular jack according to the invention. FIG. 1A is a front view; FIG. 1B, a plan view; FIG. 1C, aback view; FIG. 1D, a side view; and FIG. 1E, a bottom view. This modular jack is constituted by a housing 1, a first terminal block 3 having first terminals 2, a second terminal block 5 having second terminals 4, and an internal board 6 to be mounted with electronic parts.

FIGS. 2A–2F show the housing 1. FIG. 2A is a front view; FIG. 2B, a plan view; FIG. 2C, a back view; FIG. 2D, a side view; FIG. 2E, a bottom view; and FIG. 2F, a sectional view taken on line Y—Y in FIG. 2A. As illustrated in these views, the housing 1 has a bottom plate portion 1*a*, left and right side plate portions 1*b*, and a bridging portion 1*c* for linking the upper front portions of the left and right side plate portions 1*b* and 1*b* with each other. In addition, the housing 1 has an intermediate wall 1*d* rising upward from the bottom plate portion 1*a*. Thus, an internal space portion 1*e* into which a not-shown plug should be inserted is formed in the portion surrounded by the bottom plate portion 1*a*, the side plate portions 1*b*, the bridging portion 1*c* and the intermediate wall 1*d*.

A plurality of grooves 1*f* to which the first terminals 2 should be fitted are provided on the top of the intermediate wall 1*d*. In addition, protrusions 1*g* for preventing the first terminal block 3 from dropping off are provided on the opposite sides of the top of the intermediate wall 1*d*. In addition, a groove 1*h* to which the first terminal block 3 should be slide-fitted is provided in the inner surface of the upper portion of each side plate portion 1*b*. A plurality of recess portions 1*i* to which the front end portions of the first terminals 2 should be fitted fixedly are provided in the rear surface of the bridging portion 1*c*.

A recess portion 1*j* with which the second terminal block 5 should be linked is provided in the outer surface of each side plate portion 1*b* so as to extend forward from its rear end. A protrusion 1*k* for preventing the second terminal block 5 from dropping off is provided in each recess portion 1*j*. In addition, a link piece 1*m* for fixing the second terminal block 5 is provided in the rear portion of each side plate portion 1*b* so as to project rearward from the lower portion of the side plate portion lb. A groove 1*n* is provided in the surface opposite to each link piece 1*m*.

The bottom plate portion 1*a* has pins 1*p* for fixing the housing 1 to a not-shown motherboard.

FIGS. 3A–3C show the first terminal block 3. FIG. 3A is a plan view; FIG. 3B, a side view; and FIG. 3C, a bottom view. The first terminal block 3 is made from resin, having intermediate portions of the first terminals 2 embedded integrally with the block 3. The first terminals 2 are to be brought into contact with terminals of a not-shown plug to be inserted into the internal space portion 1*e* of the housing 1, so as to be connected to the internal board 6. To this end, each first terminal 2 is bent rearward at the portion projecting from the front end of the first terminal block 3, so as to form a contact portion 2*a* to be in contact with its corresponding terminal of the plug. In addition, the rear portion of each first terminal 2 is made to project rearward from the rear end of the first terminal block 3, so as to form a connection portion 2*b* to be connected with the internal board 6. In addition, linear protrusions 3*a* for slide-fitting to the groove 1*h* of the housing 1 are provided on the opposite sides of the first terminal block 3. In addition, protrusions 3*b* to be locked in the protrusions 1*g* of the housing 1 are provided on the opposite sides of the lower surface of the first terminal block 3.

FIGS. 4A–4F show the second terminal block 5. FIG. 4A is a front view; FIG. 4B, a plan view; FIG. 4C, a back view; FIG. 4D, a side view; FIG. 4E, a bottom view; and FIG. 4F, a sectional view showing the structure in which a second terminal is assembled. The second terminal block 5 has a plurality of second terminals 4 incorporated in a bottom plate portion 5*a*. The second terminals 4 serve to establish connection between the internal board 6 and a not-shown motherboard. Each second terminal 4 has an L-shape. As shown in FIGS. 4E and 4F, a horizontal portion of the second terminal 4 is inserted into a hole 5*b* provided in the bottom plate portion 5*a* of the second terminal block 5 so as to extend in the front/rear direction, and a vertical portion of the second terminal 4 is fitted to the groove 5*c*. Thus, the second terminal 4 is fixed to the second terminal block S.

The second terminal block 5 has a box-like shape whose front is opened to receive electronic parts. In addition, an opening (5*d*) is also provided on the top of the second terminal block 5 so that the internal board 6 and the first terminals 2 can be soldered with each other through the opening (5*d*).

In the second terminal block 5, link pieces 5*e* for slide-fitting to the recess portions 1*j* provided in the outer surfaces of the side plate portions 1*b* of the housing 1 are formed to project forward from the opposite sides of the front of the second terminal block 5. In addition, holes 5*f* to be fitted to the protrusions 1*k* in the recess portions 1*j* in order to prevent the second terminal block 5 from dropping off are provided in the link pieces 5*e* respectively.

Linear protrusions 5*g* for slide-fitting to the grooves 1*n* of the link pieces 1*m* of the housing 1 are provided on the opposite sides of the bottom plate portion 5*a*.

FIG. 5A shows the front surface of the internal board 6, and FIG. 5B shows the rear surface of the internal board 6. In the upper portion of the internal board 6, through-hole-like terminals 6*a* are arrayed, to which the connection portions 2*b* at the rear ends of the first terminals 2 should be inserted and soldered. In addition, in the lower portion of the internal board 6, through-hole-like terminals 6*b* are arrayed, to which the second terminals 4 should be inserted and soldered. In this embodiment, as the electronic parts to be mounted, a capacitor 7*a* and resistors 7*b* are mounted on the front surface of the internal board 6, and transformers 7*c* and common mode choke coils 7*d* are mounted on the rear surface of the internal board 6 so as to be as high as the mean height of the internal board 6.

An equivalent circuit diagram of the present embodiment is shown in FIG. 9.

The winding terminals 8 of the transformers 7*c* and the common mode choke coils 7*d* which are winding parts are inserted into the through holes 6*c* provided between these parts 7*c* and 7*d* and the through-hole-like terminals 6*a* in the upper portion or the through holes 6*d* provided between these electronic parts 7*c* and 7*d* and the through-hole-like terminals 6*b* in the lower portion, and soldered therein. As shown in FIG. 5A, a conductor pattern 9 establishes suitable connections between the electronic parts 7*a* and 7*b* or between the electronic parts 7*a* and 7*b* and the through-hole-like terminals 6*a* and 6*b* or the through holes 6*c* and 6*d*.

When this modular jack is assembled, the electronic parts 7*a* to 7*d* are fixed to the internal board 6 in advance by soldering. In this case, the terminals 8 of the transformers 7*c* and the common mode choke coils 7*d* which are winding parts can be soldered through the through holes 6*c* and 6*d* easily.

As for the first terminal block 3, the linear protrusions 3*a* on the opposite sides of the first terminal block 3 are slide-fitted into the grooves 1*h* of the housing 1, and the protrusions 3*b* on the lower surface of the first terminal block 3 are locked in the protrusions 1*g* of the housing 1 (see the sectional view of FIG. 6A). Thus, the first terminal block 3 is received fixedly in the top opening portion of the housing 1. FIG. 6B shows this state.

On the other hand, the terminals 4 of the second terminal block 5 are inserted into the through-hole-like terminals 6*b* arrayed in the lower portion of the internal board 6, and soldered therein in advance, as shown in FIG. 6B. Then, as soon as the second terminal block 5 is incorporated in the housing 1, the first terminals 2 are inserted into the through-hole-like terminals 6*a* arrayed in the upper portion of the internal board 6. At the same time, the link pieces 5*e* on the opposite sides of the second terminal block 5 are fitted into the recess portions 1*j* of the side plate portions 1*b* of the housing 1 so that the holes 5*f* of the link pieces 5*e* are fitted to the protrusions 1*k*. Thus, the second terminal block 5 fixed to the housing 1 is prevented from dropping off. At the same time, the linear protrusions 5*g* on the opposite sides of the bottom plate portion 5*a* of the second terminal block 5 are fitted into the grooves 1*n* of the link pieces 1*m* of the housing 1 so as to fix the bottom portion of the second terminal block 5 to the housing 1. After that, the first terminals 2 are soldered to the through-hole-like terminals 6*a* by means of a soldering iron or the like inserted from the top opening portion of the second terminal block 5.

Incidentally, the modular jack assembled thus is covered with a not-shown shielding metal cover. Excepting a front opening for receiving the connector plug and a bottom surface, all outer surfaces are covered by the metal cover.

In such a manner, the terminal block is divided into two blocks 3 and 5 on the plug terminal contact side and on the mother board connection side. As a result, in comparison with the case where the terminal block is integrated into one block, the degree of freedom in assembling structure is increased so that the modular jack can be miniaturized while assembling becomes easy.

In addition, since the through-hole-like terminals 6*a* and 6*b* making connection with the terminals 2 and 4 are provided in the internal board 6, the terminals 2 and 4 can be connected easily. Further, since the electronic parts 7*a* to 7*d* are not received into any block but mounted on the internal board 6, assembling becomes easy. In addition, in comparison with the case where the modular jack is mounted on a board, a connection device including the modular jack can be miniaturized.

In addition, since the electronic parts 7*a* to 7*d* are mounted on the internal board 6, and the first and second terminals 2 and 4 are soldered with the internal board 6, assembling becomes easy. In addition, the modular jack is not mounted on the board mounted with the electronic parts but arranged so that the terminal blocks 3 and 5 are linked with the housing 1 of the modular jack, and the internal board 6 is linked with the terminal blocks 3 and 5. Thus, the modular jack can be arranged in a small size.

When the electronic parts 7*c* and 7*d* are winding parts, the winding terminals 8 are inserted into the through holes 6*c* and 6*d*, and soldered therein in advance. Then, the terminals 2 and 4 are soldered with the internal board 6 in another process. Thus, not only the work of soldering the winding terminals 8 but also the work of soldering the terminals 2 and 4 to the internal board become easy.

FIGS. 7A–7F are views showing constituent parts in another embodiment of the modular jack according to the present invention. FIG. 8 is a sectional view showing the state where the modular jack has been assembled. In this embodiment, a first terminal block 30 having first terminals 2 and a second terminal block 50 having second terminals 4 are incorporated in a housing 10. A link structure similar to that of the aforementioned embodiment can be adopted as the structure for linking the first terminal block 30 with the housing 10. That is, linear protrusions 30*a* provided on the opposite sides of the first terminal block 30 are slide-fitted into not-shown grooves provided in the inner surfaces of side plates of the housing 10, while protrusions 30*b* of the first block 30 are locked in protrusions 10*g* provided in the top portion of an intermediate wall 10*d* of the housing 10*d* so as to prevent the first terminal block 30 from dropping off.

On the other hand, the following structure is adopted as the structure for linking the second terminal block 50 with the housing 10. That is, protrusions 50*a* of the side surfaces of the second terminal block 50 are slide-fitted into not-shown grooves provided in the inner surfaces of side plate portions of the housing 10, while protrusions 50*b* of the second terminal block 50 are locked in protrusions 10*q* provided in the intermediate wall 10*d* of the housing 10*d* so as to prevent the second terminal block 50 from dropping off. The reference numeral 10*p* represents a pin for fixing the housing 10 to a mother board.

The reference numeral 60 represents an internal board. An electronic part 7*e* which is a winding part such as a transformer or a common mode choke coil, and electronic parts

7*f* and 7*g* such as capacitors or resistors are mounted on the internal board 60. Notch-like terminals 60*a* and 60*b* are provided in the upper and lower edges of the internal board 60. In addition, the internal board 60 has through holes 60*c* and 60*d* to which winding terminals 8 of the winding part should be inserted and soldered. The reference numeral 9 represents a conductor pattern for establishing suitable connections among the electronic parts 7*e* to 7*g*, the through holes 60*c* and 60*d*, and the terminals 60*a* and 60*b*.

The reference numeral 11 represents a cover having a structure whose front is open to be linked with a rear portion of the housing 10. A structure similar to the linking structure of the second terminal block 5 in the aforementioned embodiment can be adopted as the structure for linking the cover 11 with the housing 10. That is, link pieces 11*e* of the cover 11 are fitted into recess portions 10*j* of side surfaces of the housing 10, and holes 11*f* of the link pieces 11*e* are fitted to protrusions 10*k* of the recess portions 10*j*. Thus, the cover 11 is prevented from dropping off.

When the modular jack according to this embodiment is assembled, the first and second terminal blocks 30 and 50 are incorporated in the housing 10 in advance. Then, the internal board 60 mounted with the electronic parts 7*e* to 7*g* is mounted and soldered so that the first and second terminals 2 and 4 are fitted to the notch-like terminals 60*a* and 60*b* respectively. After that, the cover 11 is attached to the housing 10 from its rear so as to cover the internal board 60 therewith.

With such a structure, the work of soldering between the internal board 60 and the first terminals 2 and between the internal board 60 and the second terminals 4 can be carried out at one time. Thus, the assembling work can be performed efficiently.

When the invention is carried out, electronic parts to be mounted on the internal board may include electronic parts such as light emitting diodes if necessary. When light emitting diodes are mounted, only a circuit pattern thereof maybe provided on the internal board 6 or 60, while a body portion thereof is provided in the housing 1 or 10, or the like.

As has been described above, according to the invention, it is possible to provide a modular jack which is easy to assemble and which can be miniaturized.

What is claimed is:

1. A modular jack comprising:

a housing having an internal space into which a plug should be inserted;

a first terminal block incorporated in said housing and integrally provided with first terminals to be in contact with terminals of the plug, so that front portions of said first terminals are exposed to said internal space, while rear ends of said first terminals project at the rear of said first terminal block;

a second terminal block having second terminals to be connected with a motherboard to which the modular jack is attached; and an internal board mounted with electronic parts and including through-hole-like or notch-like terminals to which said first and second terminals are soldered, wherein said second terminal block is incorporated on a back surface side of said housing, while said internal board is provided between said first terminal block and said second terminal block.

2. A modular jack according to claim 1, wherein said electronic parts include at least one of a common mode choke coil and a transformer.

3. A modular jack according to claim 1, wherein said electronic parts include at least one of a resistor, a capacitor and a light emitting diode.

4. A modular jack according to claim 1, wherein said electronic parts include a winding part; and said internal board has through holes to which terminals of said winding parts are inserted and soldered.

5. A modular jack according to claim 1, wherein said first terminals project out directly rearward from said first terminal block and said second terminals are L-shaped.

6. A modular jack according to claim 1, further comprising a metal cover covering outer surfaces of the modular jack.

7. A modular jack according to claim 1, wherein a plurality of through-hole-like or notch-like terminals to which said first terminals are inserted and soldered are arrayed in an upper portion of said internal board; and a plurality of through-hole-like or notch-like terminals to which said second terminals are inserted and soldered are arrayed in a lower portion of said internal board.

8. A modular jack comprising:

a housing having an internal space into which a plug should be inserted;

a first terminal block incorporated in said housing and integrally provided with first terminals to be in contact with terminals of the plug, so that front portions of said first terminals are exposed to said internal space, while rear ends of said first terminals project at the rear of said first terminal block;

a second terminal block having second terminals to be connected with a motherboard to which the modular jack is attached; and an internal board mounted with electronic parts and including through-hole-like or notch-like terminals to which said first and second terminals are soldered, wherein said first terminal block and said second terminal block are received and incorporated in said housing so that connection portions of said first and second terminals to said internal board project rearward;

said connection portions of said first and second terminals are inserted and soldered to said through-hole-like or notch-like terminals of said internal board; and a cover covering said internal board therewith is provided on the back surface side of said housing.

* * * * *